US011017709B2

(12) United States Patent
Huang et al.

(10) Patent No.: US 11,017,709 B2
(45) Date of Patent: May 25, 2021

(54) DRIVING METHOD FOR PIXEL MATRIX AND DISPLAY DEVICE

(71) Applicant: Xianyang Caihong Optoelectronics Technology Co., Ltd., Xianyang (CN)

(72) Inventors: Yusheng Huang, Xianyang (CN); Yuyeh Chen, Xianyang (CN)

(73) Assignee: XIANYANG CAIHONG OPTOELECTRONICS TECHNOLOGY CO., LTD, Xianyang (CN)

( * ) Notice: Subject to any disclaimer, the term of this patent is extended or adjusted under 35 U.S.C. 154(b) by 22 days.

(21) Appl. No.: 16/291,742

(22) Filed: Mar. 4, 2019

(65) Prior Publication Data

US 2019/0272784 A1 Sep. 5, 2019

(30) Foreign Application Priority Data

Mar. 2, 2018 (CN) ..... 201810174943.4

(51) Int. Cl.
*G09G 3/20* (2006.01)

(52) U.S. Cl.
CPC ..... *G09G 3/2074* (2013.01); *G09G 3/2003* (2013.01); *G09G 2310/027* (2013.01); *G09G 2310/0254* (2013.01); *G09G 2310/0278* (2013.01); *G09G 2310/08* (2013.01); *G09G 2320/0209* (2013.01)

(58) Field of Classification Search
CPC ..... G09G 2310/254; G09G 3/2074; G09G 3/2003; G09G 2310/27; G09G 2310/0278; G09G 2310/08; G09G 2320/0209
See application file for complete search history.

(56) References Cited

U.S. PATENT DOCUMENTS

2005/0078075 A1* 4/2005 Joo ..... G09G 3/3688 345/96
2013/0021548 A1* 1/2013 Sung ..... G09G 3/3648 349/41
2013/0127930 A1* 5/2013 Nishio ..... G09G 3/3696 345/690
2015/0145898 A1* 5/2015 Hwang ..... G09G 3/3614 345/690
2016/0133176 A1* 5/2016 Oh ..... G09G 3/3648 345/691
2016/0321984 A1* 11/2016 Kim ..... G09G 3/3614
2018/0053461 A1* 2/2018 Tien ..... G09G 3/2003

* cited by examiner

*Primary Examiner* — Lixi C Simpson
(74) *Attorney, Agent, or Firm* — WPAT, PC

(57) ABSTRACT

The invention provides a driving method for a pixel matrix. The pixel matrix includes a plurality of sub-pixels arranged in a matrix, the polarity of data lines is inverted once every two columns, the polarity of the voltage loaded in the direction of the data lines is exchanged once every N sub-pixels, and each data line alternately loads the voltage to the lth column and (I+2)th column of sub-pixels every N sub-pixels. The driving method includes: acquiring original pixel data; generating a first driving voltage and a second driving voltage according to the original pixel data; and loading the first driving voltage or the second driving voltage to the pixel matrix along the data lines within one frame, where I≥1, N≥2. In addition, the invention further provides a display device.

5 Claims, 9 Drawing Sheets

DRIVING METHOD FOR PIXEL MATRIX AND DISPLAY DEVICE

FIELD OF THE DISCLOSURE

The present invention belongs to the field of image display technologies, and more particularly to a driving method and a driving device for a pixel matrix and a display device.

BACKGROUND

VA type liquid crystal panels are relatively widely used in current display products. At present, the VA type panels are mainly divided into two types, one is the MVA (Multi-domain Vertical Alignment) type, and the other is the PVA (Patterned Vertical Alignment) type.

The principle of an MVA technology is to add protrusions to form multiple visible areas. The liquid crystal molecules are not completely vertically arranged in a static state, and the liquid crystal molecules are horizontally arranged after a voltage is loaded, so that the light can pass through respective layers. The PVA is an image vertical adjustment technology that directly changes the structure of a liquid crystal cell, so that the display performance can be greatly improved to acquire the brightness output and contrast superior to the MVA.

In the existing 4-domain VA technology, referring to FIG. 1, FIG. 1 is a schematic diagram of a driving architecture of prior art, wherein each data line loads a voltage to the sub-pixels on the right side thereof, and the polarity of the data lines is inverted once every two sub-pixels. In a 4-domain TFT-LCD, four sub-pixels are combined into a new pixel unit, two of which are in a High (H) region and two of which are in a Low (L) region to improve the Washout problem by means of reducing the resolution.

However, the above manner of the prior art improves the Washout problem to a certain extent, but the temperature raise of a driving chip caused by a relatively large power consumption of the panel is caused, which leads to the increase in a manufacturing cost and a poor user experience.

SUMMARY

In order to solve the above problems in the prior art, the present invention provides a driving method and a driving device for a pixel matrix as well as a display device, which solve the power consumption of a panel and enhance the user experience.

In a first aspect, an embodiment of the present invention provides a driving method for a pixel matrix, wherein the pixel matrix includes a plurality of sub-pixels arranged in a matrix, the polarity of data lines is inverted once every two columns, the polarity of the voltage loaded in the direction of the data lines is exchanged once every N sub-pixels, and each data line alternately loads the voltage to the lth column and (I+2)th column of sub-pixels every N sub-pixels, wherein the method includes: receiving image data, and acquiring original pixel data according to the image data; generating a first driving voltage and a second driving voltage according to the original pixel data; and loading the first driving voltage or the second driving voltage to the pixel matrix along the data lines within one frame, wherein I≥1, N≥2.

In a specific embodiment, the data lines are alternately routed on the left side of the lth column of sub-pixels and the left side of the (I+1)th column of sub-pixels, and form a bow-shaped routing structure.

In a specific embodiment, generating a first driving voltage and a second driving voltage according to the original pixel data includes: acquiring first gray scale data and second gray scale data according to the original pixel data; and generating, according to the first gray scale data and the second gray scale data, the first driving voltage corresponding to the first gray scale data, and the second driving voltage corresponding to the second gray scale data.

In a specific embodiment, acquiring first gray scale data and second gray scale data according to the original pixel data includes: acquiring an original pixel value of each pixel position according to the original pixel data, and converting the original pixel value of each pixel position into the first gray scale data or the second gray scale data according to a predetermined conversion manner.

In a specific embodiment, loading the first driving voltage or the second driving voltage to the pixel matrix along the data lines includes: alternately loading the first driving voltage and the second driving voltage to each sub-pixel in the direction of the data lines.

In a specific embodiment, generating a first driving voltage and a second driving voltage according to the original pixel data includes: acquiring an original data driving signal of each pixel position according to the original pixel data; and acquiring the first driving voltage and the second driving voltage according to the original data driving signal.

In a specific embodiment, acquiring the first driving voltage and the second driving voltage according to the original data driving signal includes: acquiring an original gray scale value of the corresponding pixel position according to the original data driving signal; and converting the original gray scale value of the corresponding pixel position to the first driving voltage or the second driving voltage according to a preset conversion rule.

In a specific embodiment, loading the first driving voltage or the second driving voltage to the pixel matrix along the data lines includes: alternately loading the first driving voltage and the second driving voltage to the adjacent sub-pixels in the direction of the data lines; and alternately loading the first driving voltage and the second driving voltage to the adjacent sub-pixels in the direction of scan lines.

In a second aspect, an embodiment of the present invention provides a display device, including a timing controller, a data driving unit, a scan driving unit and a pixel matrix, wherein in the pixel matrix, the polarity of data lines is inverted once every two columns, the polarity of the voltage loaded in the direction of the data lines is exchanged once every N sub-pixels, and each data line alternately loads the voltage to the lth column and (I+2)th column of sub-pixels every N sub-pixels; the timing controller is respectively connected to the data driving unit and the scan driving unit, and the data driving unit and the scan driving unit are both connected to the pixel matrix.

The timing controller is configured to form first gray scale data and second gray scale data according to original pixel data, and output the first gray scale data and the second gray scale data to the data driving unit.

The data driving unit is configured to generate a first driving voltage according to the first gray scale data, and generate a second driving voltage according to the second gray scale data; and load the first driving voltage or the second driving voltage to the pixel matrix in the direction of the data lines within one frame, wherein I≥1, N≥2.

In a specific embodiment, the data lines are alternately routed on the left side of the lth column of sub-pixels and the left side of the (I+1)th column of sub-pixels, and form a bow-shaped routing structure.

In a specific embodiment, the timing controller is further configured to acquire an original pixel value of each pixel position according to the original pixel data, and convert the original pixel value of each pixel position to first gray scale data or second gray scale data according to a predetermined conversion manner.

In a specific embodiment, the data driving unit is further configured to alternately load the first driving voltage and the second driving voltage to the adjacent sub-pixels in the direction of the data lines; and alternately load the first driving voltage and the second driving voltage to the adjacent sub-pixels in the direction of scan lines.

In a third aspect, an embodiment of the present invention provides another display device, including a timing controller, a data driving unit, a scan driving unit and a pixel matrix, wherein in the pixel matrix, the polarity of data lines is inverted once every two columns, the polarity of the voltage loaded in the direction of the data lines is exchanged once every N sub-pixels, and each data line alternately loads the voltage to the lth column and (I+2)th column of sub-pixels every N sub-pixels; the timing controller is connected to the data driving unit and the scan driving unit, and the data driving unit and the scan driving unit are both connected to the pixel matrix.

The timing controller is configured to acquire an original data driving signal according to original pixel data.

The data driving unit is configured to generate a first driving voltage and a second driving voltage according to the original data driving signal; and the data driving unit is further configured to load the first driving voltage or the second driving voltage to the pixel matrix in the direction of the data lines within a frame, wherein $I \geq 1$, $N \geq 2$.

In a specific embodiment, the data lines are alternately routed on the left side of the lth column of sub-pixels and the left side of the (I+1)th column of sub-pixels, and form a bow-shaped routing structure.

In a specific embodiment, the data driving unit is further configured to acquire an original gray scale value of a corresponding pixel position according to the original data driving signal; and convert the original gray scale value of the corresponding pixel position to the first driving voltage or the second driving voltage according to a preset conversion rule.

In a specific embodiment, the data driving unit is further configured to alternately load the first driving voltage and the second driving voltage to the adjacent sub-pixels in the direction of the data lines; and alternately load the first driving voltage and the second driving voltage to the adjacent sub-pixels in the direction of scan lines.

Regarding the driving method for a pixel matrix and the display device in the embodiments of the above first to third aspects, the sub-pixels in the pixel matrix are not affected by the polarity by adopting a new driving architecture and reasonably matching the high gray scale voltage and the low gray scale voltage, thereby avoiding the problems such as crosstalk and bright and dark lines, and reducing the panel power consumption, reducing the temperature of the driver IC, reducing the cost and improving the user experience at the same time.

In a fourth aspect, an embodiment of the present invention provides a driving method for a low-color shift pixel matrix, which includes: a plurality of data line pairs formed by a plurality of two adjacent data lines, wherein two sub-pixels are disposed on the inner side of each pair of data lines, and a voltage is loaded to one corresponding sub-pixel on the inner side; within one frame and in the direction of the data lines, the voltage is alternately loaded to the sub-pixels in a first driving manner or a second driving manner according to a first predetermined interval; and in the direction of scan lines, the voltage is alternately loaded to the sub-pixels in the first driving manner or the second driving manner according to a second predetermined interval.

The driving method includes: acquiring original pixel data; generating a first driving voltage and a second driving voltage according to the original pixel data; and loading the first driving voltage or the second driving voltage to the pixel matrix in the direction of the data lines within one frame.

In a specific embodiment, loading the voltage to the sub-pixels in a first driving manner includes: controlling each data line in the data line pairs to load the voltage to the adjacent sub-pixels on the inner side of such data line.

In a specific embodiment, loading the voltage to the sub-pixels in a second driving manner includes: controlling each data line in the data line pairs to load the voltage to the non-adjacent sub-pixels on the inner side of such data line.

In a specific embodiment, loading the voltage to the sub-pixels in a first driving manner includes: generating a first driving voltage and a second driving voltage according to the original pixel data, including: acquiring first gray scale data and second gray scale data according to the original pixel data; and generating, according to the first gray scale data and the second gray scale data, the first driving voltage corresponding to the first gray scale data, and the second driving voltage corresponding to the second gray scale data.

In a specific embodiment, acquiring first gray scale data and second gray scale data according to the original pixel data includes: acquiring an original pixel value of each pixel position according to the original pixel data, and converting the original pixel value of each pixel position to the first gray scale data or the second gray scale data according to a predetermined conversion manner.

In a fifth aspect, an embodiment of the present invention provides a driving device for a low-color shift pixel matrix, which includes a timing controller, a data driving unit, a scan driving unit and a pixel matrix, wherein the pixel matrix includes a plurality of data line pairs formed by a plurality of two adjacent data lines, wherein two sub-pixels are disposed on the inner side of each pair of data lines, and a voltage is loaded to one corresponding sub-pixel on the inner side; within one frame and in the direction of the data lines, the voltage is alternately loaded to the sub-pixels in a first driving manner or a second driving manner according to a first predetermined interval; and in the direction of scan lines, the voltage is alternately loaded to the sub-pixels in the first driving manner or the second driving manner according to a second predetermined interval.

The timing controller is configured to acquire original pixel data, form first gray scale data and second gray scale data according to the original pixel data, and output the first gray scale data and the second gray scale data to the data driving unit.

The data driving unit is configured to generate a first driving voltage according to the first gray scale data, and generate a second driving voltage according to the second gray scale data; and load the first driving voltage or the second driving voltage to the pixel matrix in the direction of the data lines within one frame.

In a specific embodiment, the data driving unit is further configured to control each data line in the data line pairs to load the voltage to the adjacent sub-pixels on the inner side of such data line.

In a specific embodiment, the data driving unit is further configured to control each data line in the data line pairs to load the voltage to the non-adjacent sub-pixels on the inner side of such data line.

In a specific embodiment, the timing controller is specifically configured to acquire an original pixel value of each pixel position according to the original pixel data, and convert the original pixel value of each pixel position to the first gray scale data or the second gray scale data according to a predetermined conversion manner.

In summary, regarding the driving method and driving device for a low-color shift pixel matrix in the respective embodiments of the above fourth and fifth aspects, a plurality of data line pairs are formed by a plurality of two adjacent data lines, two sub-pixels are disposed on the inner side of each pair of data lines, and the voltage is loaded to one corresponding sub-pixel on the inner side. Therefore, the 8-Domain low color shift display effect is realized without increasing the additional power consumption of the panel.

DETAILED DESCRIPTION OF PREFERRED EMBODIMENTS

The present invention will be further described in detail below with reference to specific embodiments, but the embodiments of the present invention are not limited thereto.

First Embodiment

Figure 1:
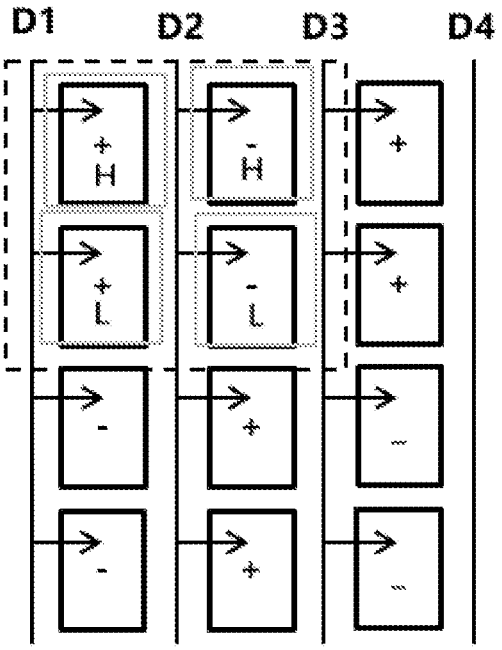
FIG. 1(Prior Art)
FIG. 1 is a schematic diagram of a driving architecture of prior art.
Figure 2:
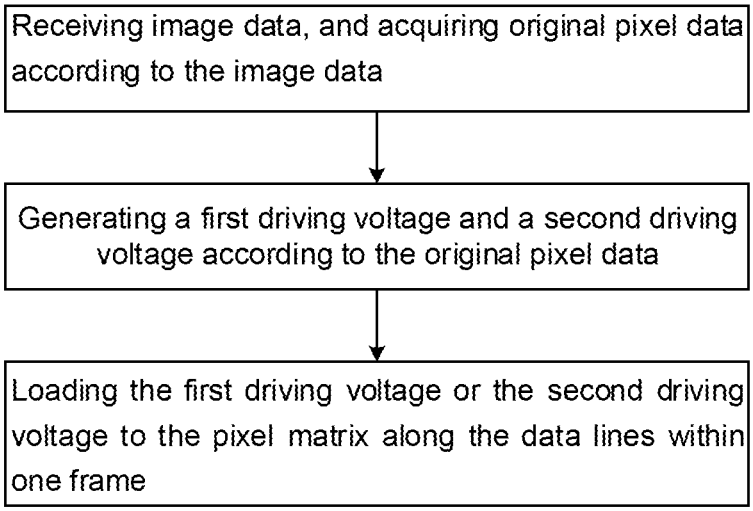
FIG. 2 is a flowchart of a driving method for a pixel matrix according to a first embodiment of the present invention.

Referring to FIG. 2, FIG. 2 is a flowchart of a driving method for a pixel matrix according to a first embodiment of the present invention. The driving method for a pixel matrix is applicable to the displays currently having a pixel array, such as an LCD display, an LED display and an OLED display.

The pixel matrix includes a plurality of sub-pixels arranged in a matrix, the polarity of data lines is inverted once every two columns, the polarity of the voltage loaded in the direction of the data lines is exchanged once every N sub-pixels, and each data line alternately loads the voltage to the lth column and (I+2)th column of sub-pixels every N sub-pixels. The driving method includes: step S1: receiving image data, and acquiring original pixel data according to the image data; S2: generating a first driving voltage and a second driving voltage according to the original pixel data; and S3: loading the first driving voltage or the second driving voltage to the pixel matrix along the data lines within one frame, wherein I≥1, N≥2.

The image data refers to a digital signal input to a timing controller (TCON). The image data is input frame by frame, and the original pixel data is acquired by parsing the image data. In an existing technology, the original pixel data is a specific pixel value correspondingly displayed by each sub-pixel in the pixel matrix within each frame, the pixel value input to each sub-pixel is directly determined by the image data input into the TCON, and the original pixel data is not processed. Such a manner is affected by the polarity of the sub-pixels, and the polarity of the sub-pixel is caused to easily generate crosstalk, bright and dark lines and other negative effects.

In a specific embodiment, generating a first driving voltage and a second driving voltage according to the original pixel data includes acquiring first gray scale data and second gray scale data according to the original pixel data; and generating, according to the first gray scale data and the second gray scale data, the first driving voltage corresponding to the first gray scale data, and the second driving voltage corresponding to the second gray scale data.

In a specific embodiment, acquiring first gray scale data and second gray scale data according to the original pixel data includes: acquiring an original pixel value of each pixel position according to the original pixel data, and converting the original pixel value of each pixel position into the first gray scale data or the second gray scale data according to a predetermined conversion manner.

In the present embodiment, by processing the original pixel data, the further first gray scale data and second gray scale data are acquired. The pixel gray scales of the first gray scale data and the second gray scale data are enabled to be different, so that the gray scales are loaded to the corresponding sub-pixels among different pixels or different frames according to a certain arrangement interval. The solution in the present embodiment can generate two groups of different gray scales corresponding to different sub-pixels respectively. In such manner, the influence on the voltage loaded to the sub-pixels caused by the polarity reversal is avoided, thereby avoiding the occurrence of crosstalk and bright dark lines.

In a specific example, the first gray scale data is, for example, high gray scale data, and the second gray scale data is, for example, low gray scale data. Correspondingly, the size of the voltage input to the sub-pixels is determined by the gray scale, so as to generate a high gray scale voltage corresponding to the high gray scale voltage, that is, the first driving voltage, and a low gray scale voltage corresponding to the low gray scale data, that is, the second driving voltage. It is mentionable that that the above high gray scale and low gray scale represent the relative values of two groups of gray scales rather than limiting the values thereof separately.

In a specific embodiment, the data lines are alternately routed on the left side of the lth column of sub-pixels and the left side of the (I+1)th column of sub-pixels, and form a bow-shaped routing structure. Specifically, referring to FIG. 3, FIG. 3 is a schematic diagram of a driving architecture for a pixel matrix according to an embodiment of the present invention.

Figure 3:
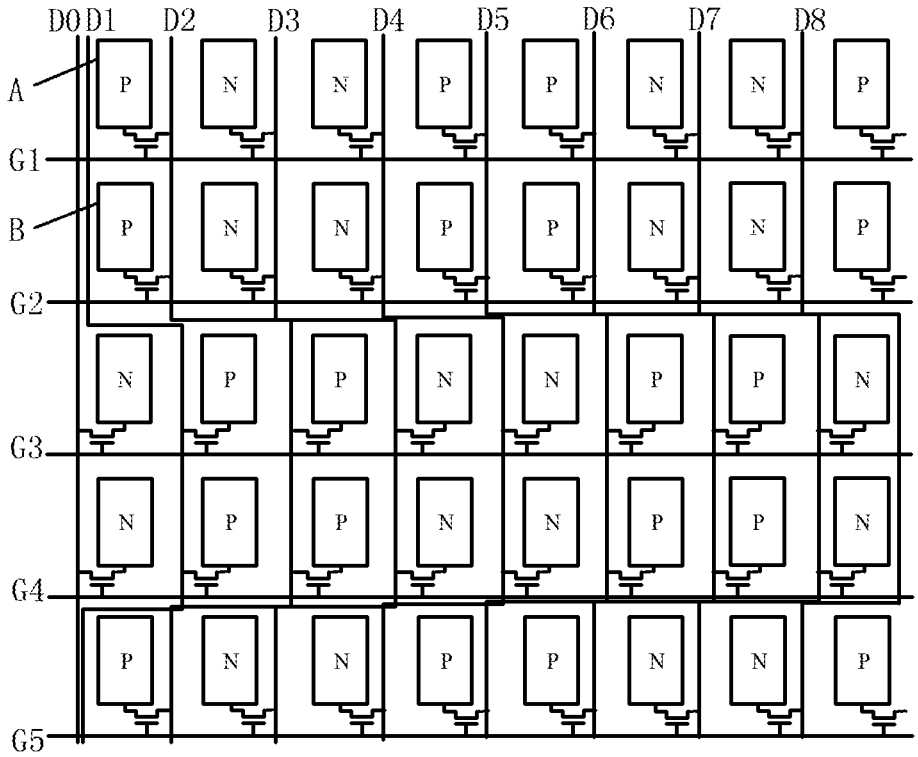
FIG. 3 is a schematic diagram of polarity loading of a pixel matrix according to the first embodiment of the present invention.

By taking N=2 as an example, the polarity of the voltage loaded in the direction of the data lines (or the length direction of the data lines, for example, the column direction in FIG. 3) is exchanged once every 2 sub-pixels. In the first column, the data line D1 is routed from the initial end in the direction of the data lines along the left side of the first sub-pixel of the first column to the middle position between the second sub-pixel and the third sub-pixel, and the data line is routed to the left side of the second column of sub-pixels in the direction of the scan lines, and routed to the middle position between the fourth sub-pixel and the fifth sub-pixel in the direction of the data lines. The data line is routed in the direction opposite to the scan lines to the left side position of the first column of sub-pixels, and is then continuously routed in the direction of the data lines, and so on till the bow-shaped routing layout is completed. During the connection, the data line D2 is taken as an example, the line close to the left side is connected to the two sub-pixels on the left side, the line close to the right side is connected to the two sub-pixels on the right side, and so on till the circuit connection layout is completed.

Viewed from a certain row, the two consecutive sub-pixels have the same polarity, and the next two consecutive sub-pixels have the polarity opposite to the above two polarities. Viewed from a certain column, the two consecutive sub-pixels have the same polarity, and the next two consecutive pixels have the polarity opposite to the above two sub-pixels, and so on. As a whole, the polarity of the voltage loaded to the sub-pixels is inverted once every two sub-pixels in the direction of the scan lines, and the polarity of the voltage loaded to the sub-pixels is inverted once every two sub-pixels in the column direction. In FIG. 3, P represents a positive voltage and N represents a negative voltage. Viewed from a certain column, the polarity reversal can be expressed as PPNN . . . PPNN or NNPP . . . NNPP, and viewed from a certain row, the polarity reversal can be expressed as PNNP . . . PNNP or NPPN . . . NPPN.

After the gray scale to be displayed by each pixel position is determined according to the rule of the present invention, the timing controller correspondingly adjusts the original gray scale of the pixel position to a high gray scale or a low gray scale, and sends the adjusted gray scale value to a data driving unit. The data driving unit outputs a corresponding voltage according to the gray scale value.

For example, the original pixel value of the A position is 128 gray scale. According to the above rule of the present invention, a high gray scale, that is, H should be output to the A position. After calculation, in such example, the H of 128 equals to the 138 gray scale value, and then the 138 gray scale is output to the A position. The data driving unit receives the 138 gray scale, according to the predetermined conversion rule, the voltage corresponding to the 138 gray scale is 10V, and finally the voltage signal of 10 V is output to the A position. Generally, the adjustment range of the high and low gray scales is determined by the difference of materials such as liquid crystal.

For another example, the original pixel value of the B position is 128 gray scale. According to the above rule of the present invention, a low gray scale, that is, L should be output to the B position. After calculation, in such example, the L of 128 equals to the 118 gray scale value, and then the 118 gray scale is output to the B position. The data driving unit receives the 118 gray scale, according to the predetermined conversion rule, the voltage corresponding to the 118 gray scale is 8V, and finally the voltage signal of 8V is output to the B position.

In a specific embodiment, loading the first driving voltage or the second driving voltage to the pixel matrix along the data lines includes: alternately loading the first driving voltage and the second driving voltage to each sub-pixel in the direction of the data lines.

Figure 4:
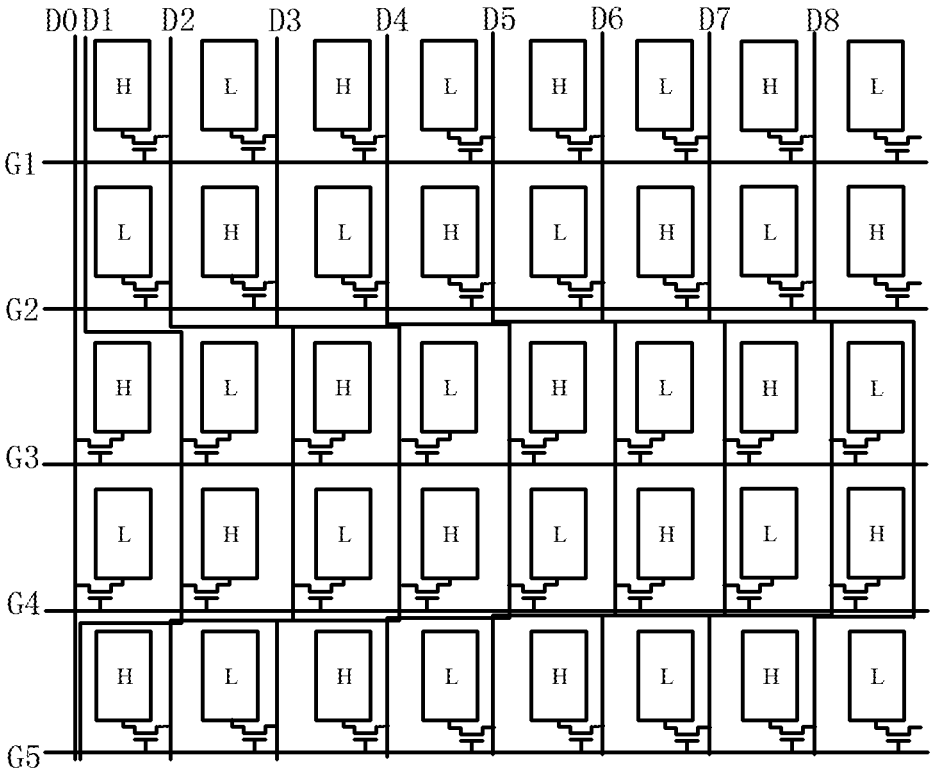
FIG. 4 is a schematic diagram of gray scale loading of a pixel matrix according to the first embodiment of the present invention.

Referring to the following example and referring to FIG. 4, FIG. 4 is a schematic diagram of gray scale loading of a pixel matrix according to an embodiment of the present invention. Viewed from a certain row, the gray scale voltage loaded into the sub-pixels is alternately converted, and viewed from a certain column, the gray scale voltage loaded to the sub-pixels is alternately converted, and so on. In FIG. 4, H represents the high gray scale voltage, and L represents the low gray scale voltage. Viewed from a certain column, the gray scale conversion can be expressed as HLHL . . . HLHL or LHLH . . . LHLH, and viewed from a certain row, the gray scale conversion can be expressed as HLHL . . . HLHL or LHLH . . . LHLH.

In the conventional driving architecture of the prior art, a 2-line inverted data line driving method is needed to improve the crosstalk problem. Herein, the design of achieving the 8-Domain H/L architecture by matching the conventional driving architecture with the 2-Line inversion will increase the power consumption of the panel, and the increase in power consumption will cause the temperature raise of the driver IC.

Or, in a specific embodiment, generating a first driving voltage and a second driving voltage according to the original pixel data includes: acquiring an original data driving signal of each pixel position according to the original pixel data; and acquiring the first driving voltage and the second driving voltage according to the original data driving signal.

In a specific embodiment, acquiring the first driving voltage and the second driving voltage according to the original data driving signal includes: acquiring an original gray scale value of the corresponding pixel position according to the original data driving signal; and converting the original gray scale value of the corresponding pixel position to the first driving voltage or the second driving voltage according to a preset conversion rule.

In the method, according to the embodiment, the original pixel data corresponds to a group of gray scale values, in the data driving circuit, the original data driving signal corresponding to the gray scale value is generated, and the original data driving signal is adjusted to two different driving voltages, that is, the first driving voltage or the second driving voltage for corresponding output. In an embodiment, the present embodiment generates the driving signal for driving the sub-pixels by using two groups of different gammas. One group of original data drive signals generates two groups of driving voltages under the action of different gammas, thereby further implementing the driving control of the present invention. In specific implementation of the solution of the embodiment, the TCON outputs a group of gray scales, the data driving circuit generates two groups of gammas, and each group respectively correspondingly drives different sub-pixels, thereby achieving the same technical effect as the above embodiment.

In summary, according to the driving method for a pixel matrix of the embodiment, by using a new driving architecture and reasonably matching the high gray scale voltage and the low gray scale voltage, the pixels in the pixel matrix are not affected by the polarity. The problems such as crosstalk and bright and dark lines are avoided, and meanwhile the power consumption of the panel is reduced, the temperature of the driver IC is reduced, the cost is reduced, and the user experience is improved.

Second Embodiment

Figure 5:
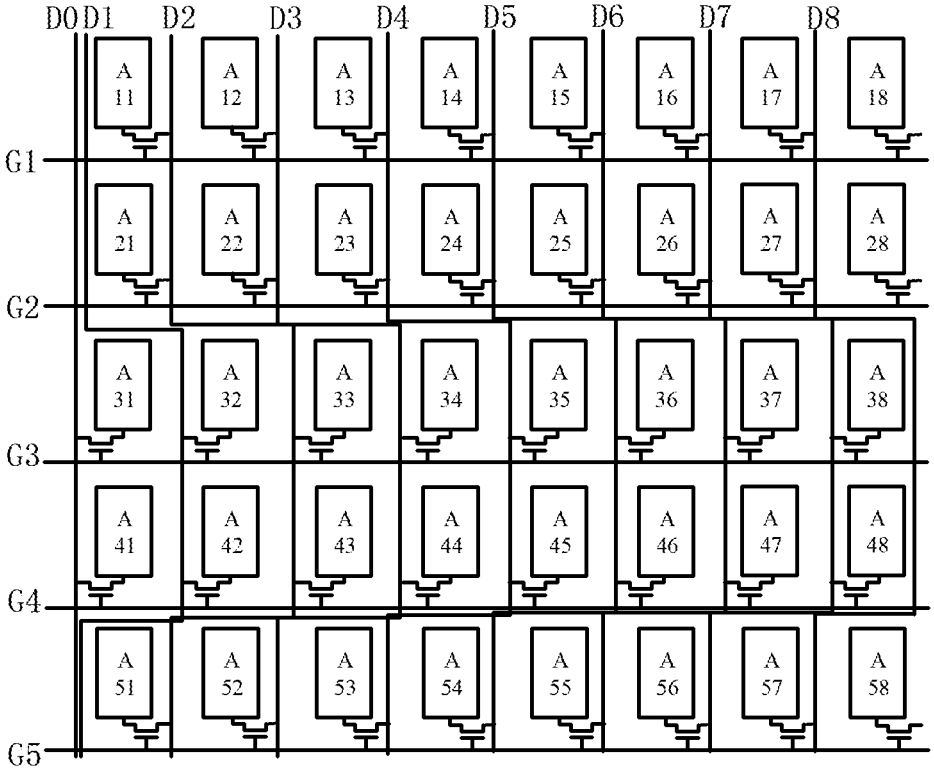
FIG. 5 is a schematic structural diagram of part of a pixel matrix when N=2 according to a second embodiment of the present invention.
Figure 6:
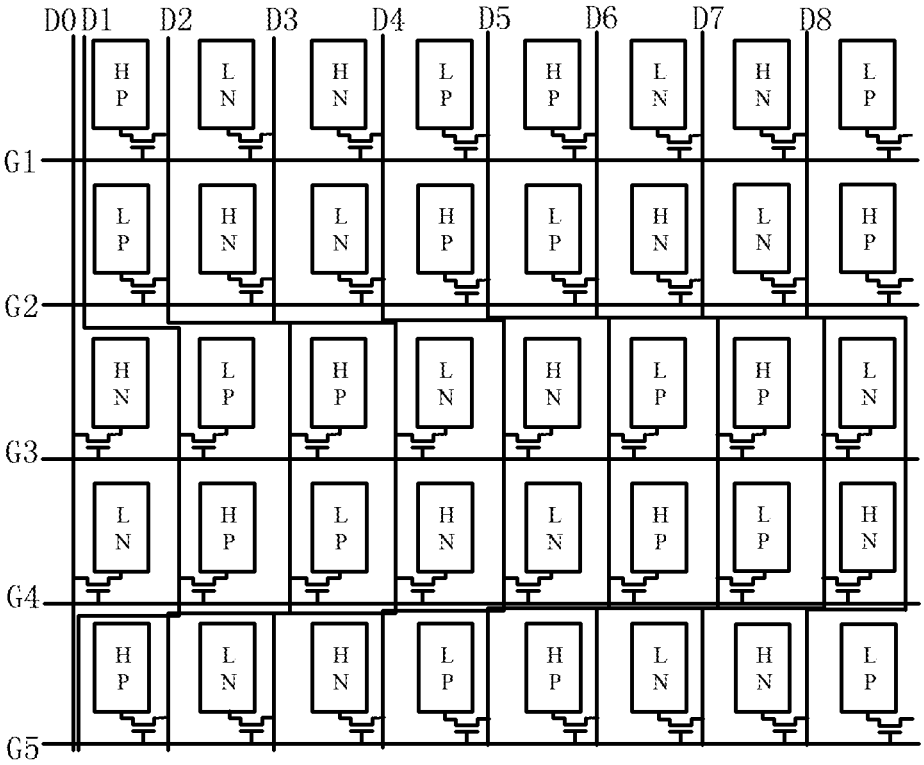
FIG. 6 is a schematic diagram of driving loading of part of a pixel matrix when N=2 according to the second embodiment of the present invention.

In one specific embodiment, corresponding to one of the above solutions, in order to more clearly show the solution of the present invention, referring to FIG. 5 and FIG. 6, FIG. 5 and FIG. 6 are schematic diagrams of part of the pixel matrix when N=2.

The D0 data line is connected to the sub-pixels A31 and A41, the D1 data line is connected to the sub-pixels A32 and A42, the D2 data line is connected to the sub-pixels A11, A21, A33, A43 and A51, the D3 data line is connected to the sub-pixels A12, A22, A34, A44 and A52, the D4 data line is connected to the sub-pixels A13, A23, A35, A45 and A53, the D5 data line is connected to the sub-pixels A14, A24, A36, A46 and A54, the D6 data line is connected to the sub-pixels A15, A25, A37, A47 and A55, the D7 data line is connected to the sub-pixels A16, A26, A38, A48 and A56, and the D8 data line is connected to the sub-pixels A17, A27 and A57. The G1 scan line is connected to the sub-pixels A11, A12, A13, A14, A15, A16, A17 and A18, the G2 scan line is connected to the sub-pixels A21, A22, A23, A24, A25, A26, A27 and A28, the G3 scan line is connected to the sub-pixels A31, A32, A33, A34, A35, A36, A37 and A38, the G4 scan line is connected to the sub-pixels A41, A42, A43, A44, A45, A46, A47 and A48, and the G5 scan line is connected to the sub-pixels A51, A52, A53, A54, A55, A56, A57 and A58.

According to the matching relationship between a pair of voltage polarity and voltage gray scale loaded to the sub-pixels of the embodiment of the present invention, a specific embodiment manner is shown, and within one frame:

The voltage polarities and the H/L characteristics correspondingly loaded to the sub-pixels A11, A12, A13, A14, A15, A16, A17, and A18 at a first moment are: HP, LN, HN, LP, HP, LN, HN and LP in sequence.

The voltage polarities and the H/L characteristics correspondingly loaded to the sub-pixels A21, A22, A23, A24, A25, A26, A27, and A28 at a second moment are: LP, HN, LN, HP, LP, HN, LN and HP in sequence.

The voltage polarities and the H/L characteristics correspondingly loaded to the sub-pixels A31, A32, A33, A34, A35, A36, A37, and A38 at a third moment are: HN, LP, HP, LN, HN, LP, HP and LN in sequence.

The voltage polarities and the H/L characteristics correspondingly loaded to the sub-pixels A41, A42, A43, A44, A45, A46, A47, and A48 at a fourth moment are: LN, HP, LP, HN, LN, HP, LP and HN in sequence.

The voltage polarities and the H/L characteristics correspondingly loaded to the sub-pixels A51, A52, A53, A54, A55, A56, A57, and A58 at a fifth moment are: HP, LN, HN, LP, HP, LN, HN and LP in sequence, and so on till the voltage loading within one frame is completed, and the polarity of the data line is changed within the next frame for voltage loading according to the above principle.

According to the driving method for a pixel matrix of the embodiment, by using a new driving architecture and reasonably matching the high gray scale voltage and the low gray scale voltage, the pixels in the pixel matrix are not affected by the polarity. The problems such as crosstalk and bright and dark lines are avoided, and meanwhile the power consumption of the panel is reduced, the temperature of the driver IC is reduced, the cost is reduced, and the user experience is improved.

Third Embodiment

Figure 7:
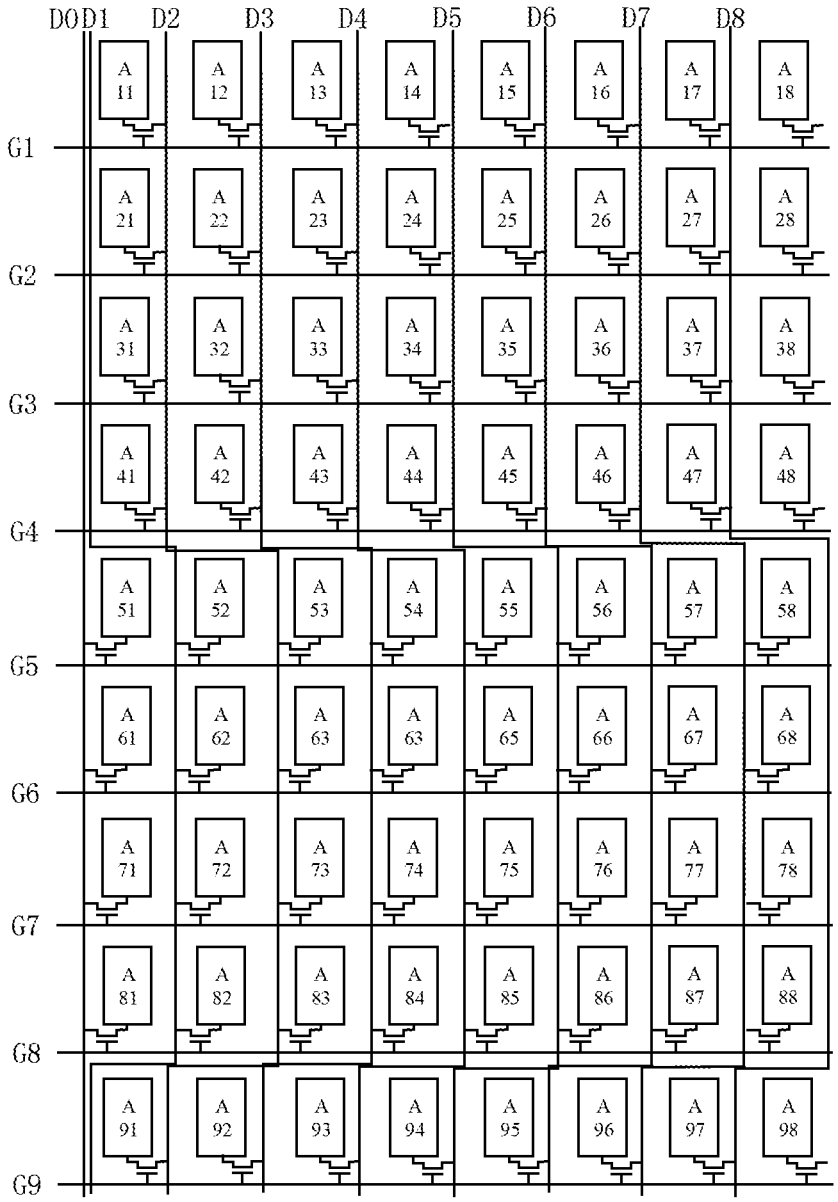
FIG. 7 is a schematic structural diagram of part of a pixel matrix when N=4 according to a third embodiment of the present invention.
Figure 8:
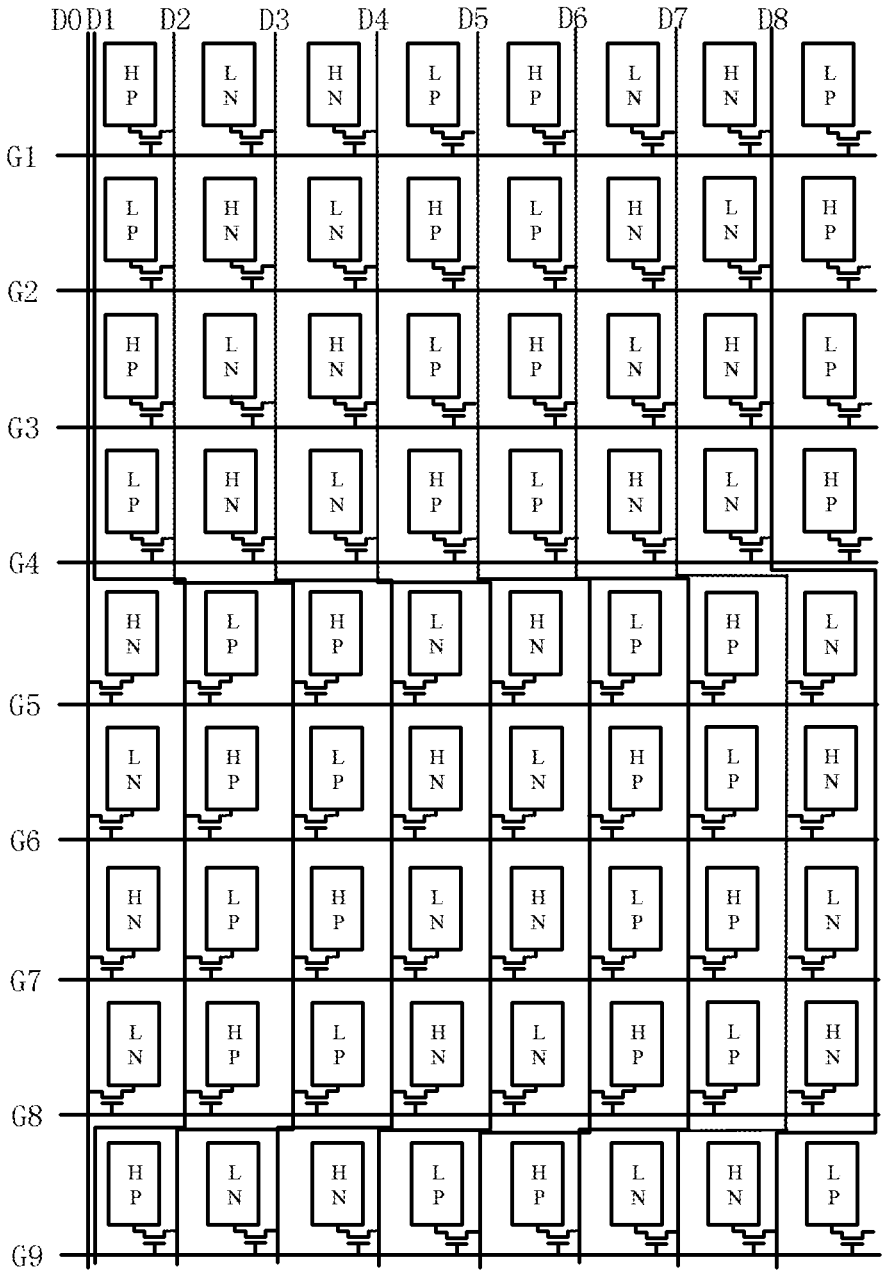
FIG. 8 is a schematic diagram of driving loading of part of a pixel matrix when N=4 according to the third embodiment of the present invention.

In one specific embodiment, corresponding to one of the above solutions, in order to more clearly show the solution of the present invention, referring FIG. 7 and FIG. 8. FIG. 7 and FIG. 8 are schematic diagrams of part of the pixel matrix when N=4.

The D0 data line is connected to the sub-pixels A51, A61, A71, and A81, the D1 data line is connected to the sub-pixels A52, A62, A72, and A82, the D2 data line is connected to the sub-pixels A11, A21, A31, A41, A53, A63, A73, A83 and A91, the D3 data line is connected to the sub-pixels A12, A22, A32, A42, A54, A64, A74, A84 and A92, the D4 data line is connected to the sub-pixels A13, A23, A33, A43, A55, A65, A75, A85 and A93, the D5 data line is connected to the sub-pixels A14, A24, A34, A44, A56, A66, A76, A86 and A94, the D6 data line is connected to the sub-pixels A15, A25, A35, A45, A57, A67, A77, A87 and A95, the D7 data line is connected to the sub-pixels A16, A26, A36, A46, A58, A68, A78, A88 and A96, and the D8 data line is connected to the sub-pixels A17, A27, A37, A47 and A97.

The G1 scan line is connected to the sub-pixels A11, A12, A13, A14, A15, A16, A17 and A18, the G2 scan line is connected to the sub-pixels A21, A22, A23, A24, A25, A26, A27 and A28, the G3 scan line is connected to the sub-pixel A31, A32, A33, A34, A35, A36, A37 and A38, the G4 scan line is connected to the sub-pixels A41, A42, A43, A44, A45, A46, A47 and A48, the G5 scan line is connected to the sub-pixels A51, A52, A53, A54, A55, A56, A57 and A58, the G6 scan line is connected to the sub-pixels A61, A62, A63, A64, A65, A66, A67 and A68, the G7 scan line is connected to the sub-pixels A71, A72, A73, A74, A75, A76, A77 and A78, and the G8 scan line is connected to the sub-pixels A81, A82, A83, A84, A85, A86, A87, and A88.

According to the matching relationship between a pair of voltage polarity and voltage gray scale loaded to the sub-pixels of the embodiment of the present invention, a specific embodiment manner is shown, and within one frame:

The voltage polarities and the H/L characteristics correspondingly loaded to the sub-pixels A11, A12, A13, A14, A15, A16, A17, and A18 at a first moment are: HP, LN, HN, LP, HP, LN, HN and LP in sequence.

The voltage polarities and the H/L characteristics correspondingly loaded to the sub-pixels A21, A22, A23, A24, A25, A26, A27, and A28 at a second moment are: LP, HN, LN, HP, LP, HN, LN and HP in sequence.

The voltage polarities and the H/L characteristics correspondingly loaded to the sub-pixels A31, A32, A33, A34, A35, A36, A37, and A38 at a third moment are: HP, LN, HN, LP, HP, LN, HN and LP in sequence.

The voltage polarities and the H/L characteristics correspondingly loaded to the sub-pixels A41, A42, A43, A44, A45, A46, A47, and A48 at a fourth moment are: LP, HN, LN, HP, LP, HN, LN and HP in sequence.

The voltage polarities and the H/L characteristics correspondingly loaded to the sub-pixels A51, A52, A53, A54, A55, A56, A57 at a fifth moment and A58 are: HN, LP, HP, LN, HN, LP, HP and LN in sequence.

The voltage polarities and the H/L characteristics correspondingly loaded to the sub-pixels A61, A62, A63, A64, A65, A66, A67, and A68 at a sixth moment are: LN, HP, LP, HN, LN, HP, LP and HN in sequence.

The voltage polarities and the H/L characteristics correspondingly loaded to the sub-pixels A71, A72, A73, A74, A75, A76, A77, and A78 at a seventh moment are: HN, LP, HP, LN, HN, LP, HP and LN in sequence.

The voltage polarities and the H/L characteristics correspondingly loaded to the sub-pixels A81, A82, A83, A84, A85, A86, A87, and A88 at an eighth moment are: LN, HP, LP, HN, LN, HP, LP and HN in sequence.

The voltage polarities and the H/L characteristics correspondingly loaded to the sub-pixels A91, A92, A93, A94, A95, A96, A97, and A98 at a ninth moment are: HP, LN, HN, LP, HP, LN, HN and LP in sequence, and so on till the voltage loading within one frame is completed, and the polarity of the data line is changed within the next frame for voltage loading according to the above principle.

According to the driving method for a pixel matrix of the embodiment, by using a new driving architecture and reasonably matching the high gray scale voltage and the low gray scale voltage, the pixels in the pixel matrix are not affected by the polarity. The problems such as crosstalk and bright and dark lines are avoided, and meanwhile the power consumption of the panel is reduced, the temperature of the driver IC is reduced, the cost is reduced, and the user experience is improved.

Fourth Embodiment

Figure 9:
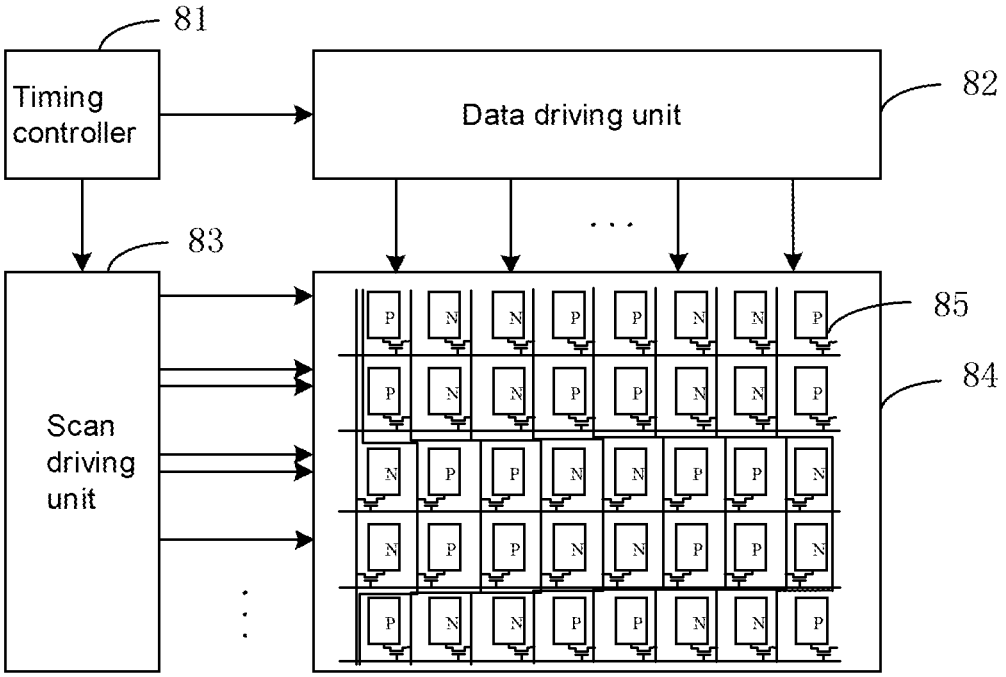
FIG. 9 is a schematic diagram of a display device according to a fourth embodiment of the present invention.

Referring to FIG. 9, FIG. 9 is a schematic diagram of a display device according to a fourth embodiment of the present invention. The present invention provides a display device configured to perform the driving method for a pixel matrix according to the present invention. In the pixel matrix, the polarity of the data lines is inverted every two columns, the polarity of the voltage loaded in the direction of the data lines is exchanged once every N sub-pixels, and every N sub-pixels, each data line alternately loads the voltage to the lth column and the (I+2)th column of sub-pixels. The display device includes a timing controller 81, a data driving unit 82, a scan driving unit 83 and a display panel 84, wherein the display panel 84 is provided with a pixel matrix 85. The timing controller 81 is connected to the data driving unit 82 and the scan driving unit 83 respectively, and the data driving unit 82, and the scan driving unit 83 are connected to the pixel matrix 85.

The timing controller 81 is configured to form first gray scale data and second gray scale data according to original pixel data, and output the first gray scale data and the second gray scale data to the data driving unit 82.

The data driving unit 82 is configured to generate a first driving voltage according to the first gray scale data, and generate a second driving voltage according to the second gray scale data; and load the first driving voltage or the second driving voltage to the pixel matrix 85 in the direction of the data lines within one frame a to, wherein I≥1, N≥2.

In one specific embodiment, the data lines are alternately routed on the left side of the lth column of sub-pixels and the left side of the (I+1)th column of sub-pixels, and form a bow-shaped routing structure.

In one specific embodiment, the timing controller 81 is further configured to acquire an original pixel value of each pixel position according to the original pixel data, and convert the original pixel value of each pixel position to first gray scale data or second gray scale data according to a predetermined conversion manner.

In a specific embodiment, the data driving unit is further configured to alternately load the first driving voltage and the second driving voltage to the adjacent sub-pixels in the direction of the data lines; and alternately load the first driving voltage and the second driving voltage to the adjacent sub-pixels in the direction of scan lines.

The display panel 84 includes a plurality of data lines, a plurality of scan lines, and a plurality of sub-pixels connected to the data lines and the scan lines. The sub-pixels are arranged on the display panel in the direction of the data lines and in the direction of the scan lines to form the pixel matrix 85. The timing controller 81 inputs the RGB data signal of an image from the outside, The timing controller 81 can input red image data R, green image data G blue image data B, or image data of other colors from the outside, and generate corresponding original pixel data according to the image data. The original pixel data is enabled to correspond to two groups of gray scales: high gray scale data and low gray scale data according to the above rule of the present invention. The data driving circuit converts the high gray scale data and the low gray scale data respectively by using a fixed gamma and then outputs a corresponding high gray scale voltage and a low gray scale voltage. The data driving unit 82 controls the specific output operation according to the above method of the present invention, and correspondingly selects the output of the high gray scale, low gray scale, positive voltage, and negative voltage according to the timing.

One embodiment of the present invention also discloses another display device, including a timing controller 81, a data driving unit 82, a scan driving unit 83, and a pixel matrix 85. In the pixel matrix 85, the polarity of the data lines is inverted every two columns, the polarity of the voltage loaded in the direction of the data lines is exchanged once every N sub-pixels, and every N sub-pixels, each data line alternately loads the voltage to the lth column and the (I+2)th column of sub-pixels. The timing controller 81 is connected to the data driving unit 82 and the scan driving unit 83 respectively, and the data driving unit 82, and the scan driving unit 83 are connected to the pixel matrix 85.

The timing controller 81 is configured to acquire an original data driving signal according to the original pixel data.

The data driving unit 82 is configured to generate a first driving voltage and a second driving voltage according to the original data driving signal; and within a frame, the data driving unit 82 is further configured to load the first driving voltage or the second driving voltage to the pixel matrix 85 in the direction of the data lines, wherein I≥1, N≥2.

In one embodiment, the data lines are alternately routed on the left side of the lth column of sub-pixels and the left side of the (I+1)th column of sub-pixels, and form a bow-shaped routing structure.

In a specific embodiment, the data driving unit 82 is further configured to acquire an original gray scale value of the corresponding pixel position according to the original data driving signal; and convert the original gray scale value of the corresponding pixel position into the first driving voltage or the second driving voltage according to a preset conversion rule.

In a specific embodiment, the data driving unit 82 is further configured to alternately load the first driving voltage and the second driving voltage to the adjacent sub-pixels in the direction of the data lines; and alternately load the first driving voltage and the second driving voltage to the adjacent sub-pixels in the direction of the scan lines.

The timing controller 81 inputs the image data from the outside, generates corresponding original pixel data according to the image data, and outputs the original data driving signal to the data driving circuit. Since the data driving circuit only receives the original gray scale value and the corresponding H or L conversion rule, the data drive circuit correspondingly generates a high-gamma high gray scale voltage and a low-gamma low gray scale voltage by two different groups of gammas. The data driving unit 82 controls the specific output operation according to the above method of the present invention, and correspondingly selects the output of the high gray scale, low gray scale, positive voltage, and negative voltage according to the timing.

According to the display device of the embodiment, by adopting the new driving structure and reasonably matching the high gray scale voltage and the low gray scale voltage, the sub-pixels in the pixel matrix are not affected by the polarity. The problems of crosstalk, bright and dark lines, etc., are avoided, and meanwhile the panel power consumption is reduced, the temperature of the driver IC is lowered, the cost is reduced, and the user experience is improved.

Fifth Embodiment

Figure 10:
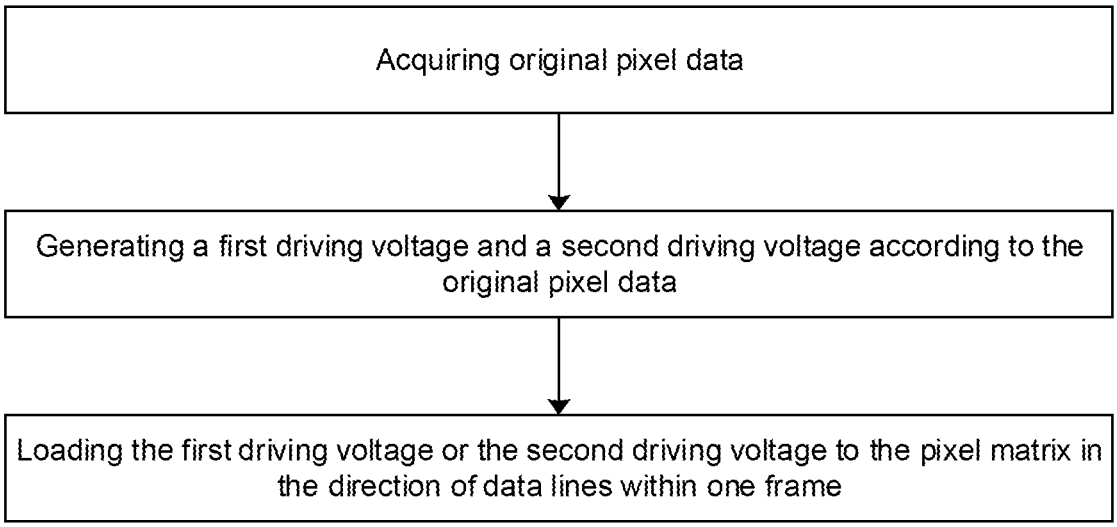
FIG. 10 is a flowchart of a driving method for a low-color shift pixel matrix according to a fifth embodiment of the present invention.

Referring to FIG. 10, FIG. 10 is a flowchart of a driving method for a low-color shift pixel matrix according to a fifth embodiment of the present invention. The driving architecture of the present embodiment includes a plurality of data line pairs formed by a plurality of two adjacent data lines. Two sub-pixels are disposed on the inner side of each pair of data lines, and a voltage is loaded to one corresponding sub-pixel on the inner side. Within one frame and in the direction of the data lines, the voltage is alternately loaded to the sub-pixels in a first driving manner or a second driving manner according to a first predetermined interval. In the direction of scan lines, the voltage is alternately loaded to the sub-pixels in the first driving manner or the second driving manner according to a second predetermined interval.

The driving method includes: acquiring original pixel data; generating a first driving voltage and a second driving voltage according to the original pixel data; and loading the first driving voltage or the second driving voltage to the pixel matrix in the direction of the data lines within one frame.

According to the above, the original pixel data is the specific pixel value correspondingly displayed by each sub-pixel in the pixel matrix within each frame, the pixel value input to each sub-pixel is directly determined by the image data input into the TCON, and the original pixel data is not processed. Such a manner is affected by the polarity of the sub-pixels, and the polarity of the sub-pixel is caused to easily generate crosstalk, bright and dark lines and other negative effects.

According to the driving method for a low-color shift pixel matrix of the present embodiment, a plurality of data line pairs are formed by a plurality of two adjacent data lines, two sub-pixels are disposed on the inner side of each pair of data lines, and the voltage is loaded to one corresponding sub-pixel on the inner side. Therefore, the 8-Domain low-color shift display effect is realized without increasing the additional power consumption of the panel.

Figure 11:
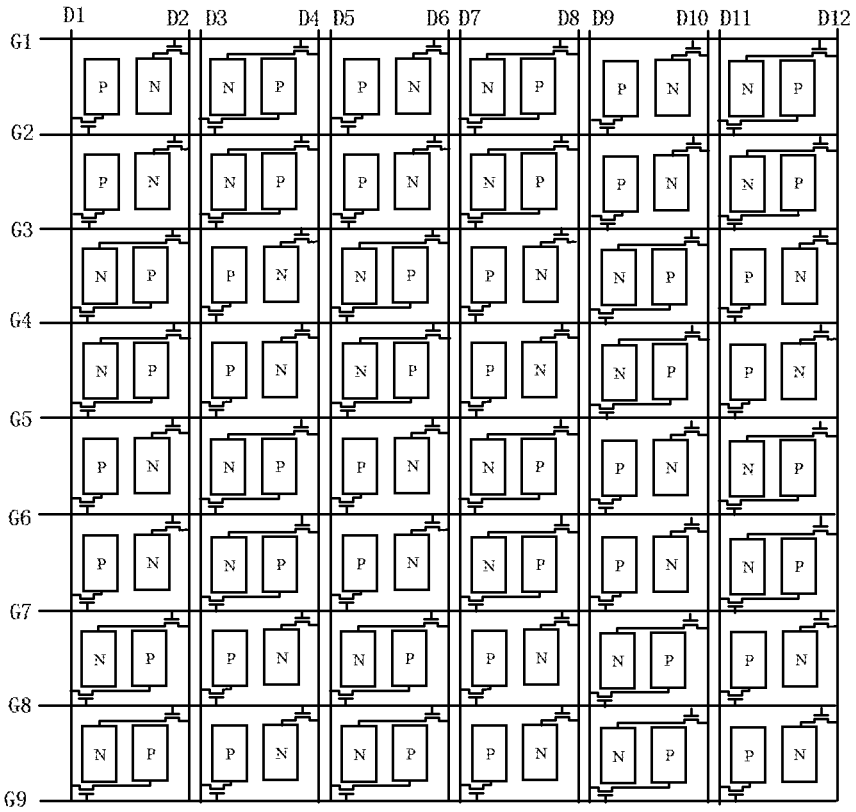
FIG. 11 is a schematic diagram of a driving architecture for a low-color shift pixel matrix according to the fifth embodiment of the present invention.

For the driving architecture of the present embodiment, referring to FIG. 11, FIG. 11 is a schematic diagram of a driving architecture for a low color-shift pixel matrix according to an embodiment, which is exemplified by 8×12, that is, there are 8 rows and 12 columns of sub-pixels. For more convenient description, each sub-pixel is marked, the sub-pixel of the Nth row and the Mth column is marked as Anm, and the sub-pixel of the first row and the first column is marked as A11.

The data lines D1 and D2 are one data line pair, the data lines D3 and D4 are one data line pair, and so on.

Two sub-pixels are disposed between D1 and D2, D1 is connected to the sub-pixel A11, and D2 is connected to the sub-pixel A12. In such manner, the voltage is loaded to the sub-pixels in the first driving manner, and each data line in the data line pair loads the voltage to the adjacent sub-pixels on the inner side of such data line.

Two sub-pixels are disposed between D3 and D4, D3 is connected to the sub-pixel A14 and D4 is connected to the sub-pixel A13. In such manner, the voltage is loaded to the sub-pixels in the second driving manner, and each of the data line pairs loads the voltage to the non-adjacent sub-pixels on the inner side of such data line.

According to the above rule, within one frame, the voltage is loaded to the sub-pixels alternately in the first driving manner or the second driving manner every two sub-pixels in the direction of the data lines according to the embodiment, that is, at the first moment and the second moment, the voltage is loaded to the sub-pixels in the first driving manner, at the third moment and the fourth moment, the voltage is loaded to the sub-pixels in the second driving manner, at the fifth moment and the sixth moment, the voltage is loaded to the sub-pixels in the first driving manner, at the seventh moment and the eighth moment, the voltage is loaded to the sub-pixels in the second driving manner and so on. In the present embodiment, the first predetermined interval is every other two sub-pixels.

In the present embodiment, the voltage is loaded to the sub-pixels alternately in the first driving manner or the second driving manner every two sub-pixels in the direction of the scan lines, that is, at the same moment, D1 and D2 load the voltage to the sub-pixels in the first driving manner, D3 and D4 load the voltage to the sub-pixels in the second driving manner, D5 and D6 load the voltage to the sub-pixels in the first driving manner, D7 and D8 load the voltage to the sub-pixels in the second driving manner, and so on. In the present embodiment, the second predetermined interval is every other two sub-pixels. In the data line pair, the adjacent data line pairs alternately load in the first driving manner and the second driving manner.

For the present embodiment, the polarities of two adjacent data lines are also alternately changed. Within one frame, the data line D1 is loaded with the positive polarity voltage, the data line D2 is loaded with the negative polarity voltage, the data line D3 is loaded with the positive polarity voltage, the data line D4 is loaded with the negative polarity voltage, and so on. In the direction of the data lines, the polarity of the data lines is constant within one frame, but for the driving architecture of the present invention, the polarity of the voltage loaded to the sub-pixels of each column is inverted once every two sub-pixels, thereby achieving 2-Line inversion. The polarity of the sub-pixels of each column is in the two-positive and two-negative cycle.

Similarly, in the direction of the scan lines, the polarity of the data lines is column inversion within one frame, but for the driving architecture of the embodiment, the polarity of the voltage loaded to the sub-pixels of each row is inverted once every two sub-pixels, thus achieving 2-Line inversion, and the polarity of the sub-pixels of each row is in two-positive and two-negative cycle.

In one embodiment, loading the voltage to the sub-pixels in the first driving manner includes: generating the first driving voltage and the second driving voltage according to the original pixel data, including: acquiring first gray scale data and second gray scale data according to the original pixel data; and generating, according to the first gray scale data and the second gray scale data, the first driving voltage corresponding to the first gray scale data, and the second driving voltage corresponding to the second gray scale data.

In a specific embodiment, acquiring first gray scale data and second gray scale data according to the original pixel data includes: acquiring an original pixel value of each pixel position according to the original pixel data, and converting the original pixel value of each pixel position to the first gray scale data or the second gray scale data according to a predetermined conversion manner.

According to the above, in the present embodiment, by processing the original pixel data, the further first gray scale data and second gray scale data are acquired. The pixel gray scales of the first gray scale data and the second gray scale data are enabled to be different, so that the gray scales are loaded to the corresponding sub-pixels among different pixels or different frames according to a certain arrangement interval. The solution in the present embodiment can generate two groups of different gray scales corresponding to different sub-pixels respectively. In such manner, the influence on the voltage loaded to the sub-pixels caused by the polarity reversal is avoided, thereby avoiding the occurrence of crosstalk and bright dark lines.

In a specific example, the first gray scale data is, for example, high gray scale data, and the second gray scale data is, for example, low gray scale data. Correspondingly, the size of the voltage input to the sub-pixels is determined by the gray scale, so as to generate a high gray scale voltage corresponding to the high gray scale voltage, that is, the first driving voltage, and a low gray scale voltage corresponding to the low gray scale data, that is, the second driving voltage. It is mentionable that that the above high gray scale and low gray scale represent the relative values of two groups of gray scales rather than limiting the values thereof separately.

After the gray scale to be displayed by each pixel position is determined according to the rule of the present invention, the timing controller correspondingly adjusts the original gray scale of the pixel position to a high gray scale or a low gray scale, and sends the adjusted gray scale value to the data driving unit. The data driving unit outputs a corresponding voltage according to the gray scale value.

For example, the original pixel value of the A position is 128 gray scale. According to the above rule of the present invention, a high gray scale, that is, H should be output to the A position. After calculation, in such example, the H of 128 equals to the 138 gray scale value, and then the 138 gray scale is output to the A position. The data driving unit receives the 138 gray scale, according to the predetermined conversion rule, the voltage corresponding to the 138 gray scale is 10 V, and finally the voltage signal of 10V is output to the A position. Generally, the adjustment range of the high and low gray scales is determined by the difference of materials such as liquid crystal.

For another example, the original pixel value of the B position is 128 gray scale. According to the above rule of the present invention, a low gray scale, that is, L should be output to the B position. After calculation, in such example, the L of 128 equals to the 118 gray scale value, and then the 118 gray scale is output to the B position. The data driving unit receives the 118 gray scale, according to the predetermined conversion rule, the voltage corresponding to the 118 gray scale is 8V, and finally the voltage signal of 8V is output to the B position.

Figure 12:
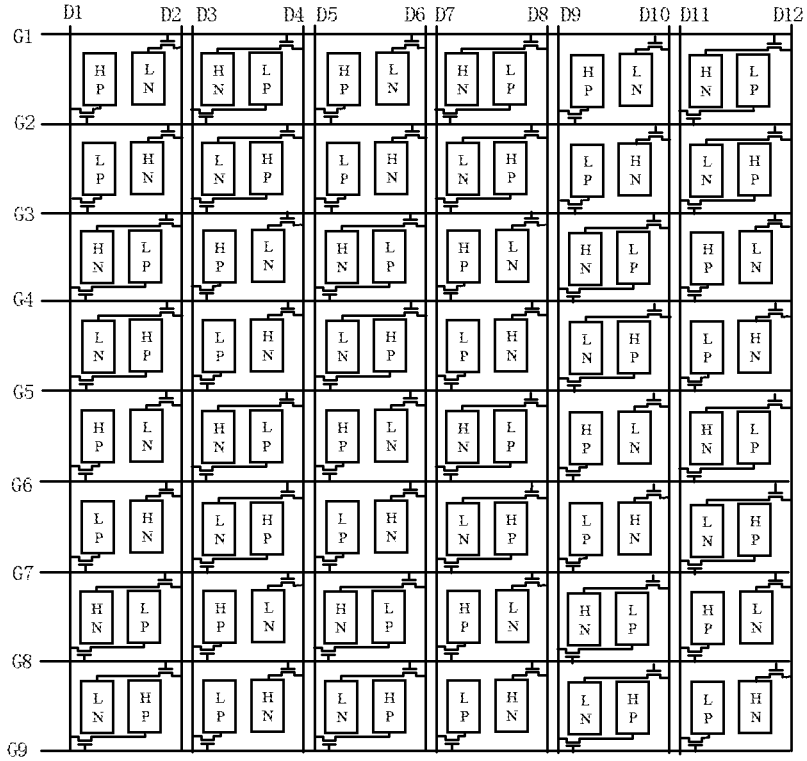
FIG. 12 is a schematic diagram of pixel display of a low-color shift pixel matrix according to the fifth embodiment of the present invention.

Specific to the architecture of the present invention, referring to FIG. 12, FIG. 12 is a schematic diagram of pixel display of a low-color shift pixel matrix according to an embodiment of the present invention. The specific explanation is as follows:

At a first moment within a frame, a scan signal is loaded on the scan line G1 of the first row, the voltage corresponding to the LN (negative low gray scale) is loaded to the pixel A12 on the second data line D2, the voltage corresponding to the HN (negative high gray scale) is loaded to the pixel A13 on the data line D4, and according to the above rule, the corresponding polarities and gray scale voltages are loaded to other pixels of the first row.

At the next moment (i.e., the second moment), the scan signal is loaded on the scan lien G2 of the second row, the voltage corresponding to the HP is loaded to the pixel A11 on the first data line D1, the voltage corresponding to the HN is loaded to the pixel A22 on the second data line D2, the voltage corresponding to the LP is loaded to the pixel A14 on third data line D3, the voltage corresponding to the LN is loaded to the pixel A23 on the fourth data line D4, and according to the above rule, the corresponding polarities and gray scale voltages are loaded to other pixels of the second row.

At the next moment (i.e., the third moment), the scan signal is loaded on the scan line G3 of the third row, the voltage corresponding to the LP is loaded to the pixel A21 on the first data line D1, the voltage corresponding to the HN is loaded to the pixel A31 on the second data line D2, the voltage corresponding to the HP is loaded to the pixel A24 on the third data line D3, the voltage corresponding to the LN is loaded to the pixel A34 on the fourth data line D4, and according to the above rule, the corresponding polarities and gray scale voltages are loaded to other pixels of the third row.

At the next moment (i.e., the fourth moment), the scan signal is loaded on the scan line G4 of the fourth row, the voltage corresponding to the LP is loaded to the pixel A32 on the first data line D1, the voltage corresponding to the LN is loaded to the pixel A41 on the second data line D2, the voltage corresponding to the HP is loaded to the pixel A33 on the third data line D3, the voltage corresponding to the HN is loaded to the pixel A44 on the fourth data line D4, and according to the above rule, the corresponding polarities and gray scale voltages are loaded to other pixels of the fourth row.

At the next moment (i.e., the fifth time), the scan signal is loaded on the scan line G5 of the fifth row, the voltage corresponding to the HP is loaded to the pixel A42 on the first data line D1, the voltage corresponding to the LN is loaded to the pixel A52 on the second data line D2, the voltage corresponding to the LP is loaded to the pixel A43 on the third data line D3, the voltage corresponding to the HN is loaded to the pixel A53 on the fourth data line D4, and according to the above rule, the corresponding polarities and gray scale voltages are loaded to the other pixels of the fifth row.

In the present embodiment, the voltage loading conditions at the first five scanning moments are listed, and the corresponding voltages are sequentially loaded to other sub-pixels at other moments according to the above rules. That is to say, the minimum unit of the cyclic loading is 4×4 sub-pixels, and the voltage loading condition at the sixth moment can refer to the voltage loading condition at the second moment.

According to the above embodiment of the present invention, by alternately loading the positive and negative polarity voltages and the high and low gray scale voltages to the pixel matrix, the side visibility can be improved, so that the pixels in the pixel matrix are not affected by the polarity, the problems such as crosstalk and bright and dark lines are improved, and the display effect is improved.

Sixth Embodiment

Figure 13:
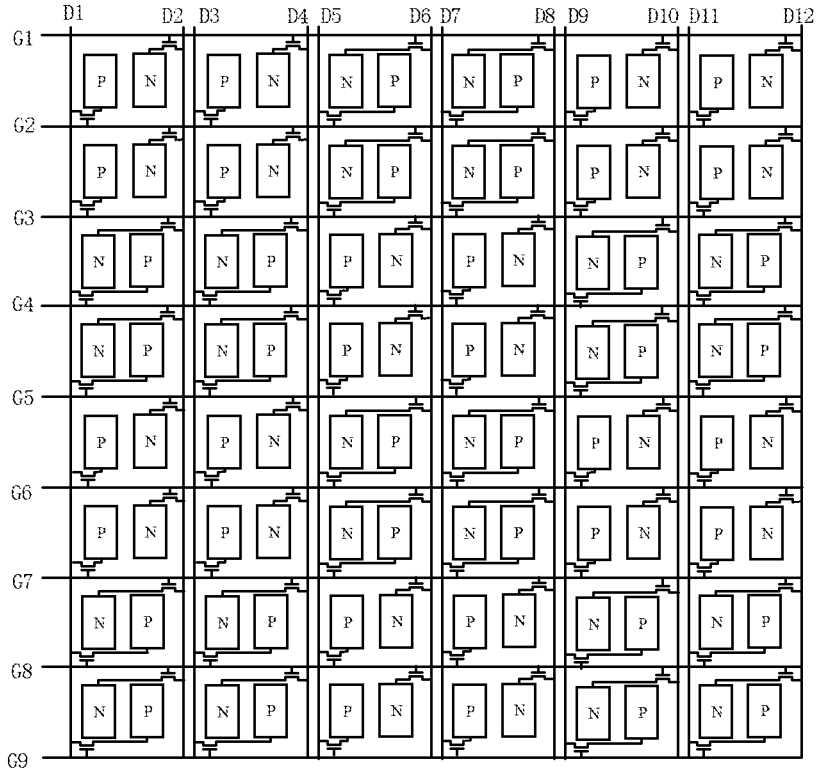
FIG. 13 is a schematic diagram of a driving architecture for a low-color shift pixel matrix according to a sixth embodiment of the present invention.

Referring to FIG. 13, FIG. 13 is a schematic diagram of a driving architecture for a low color-shift pixel matrix according to a sixth embodiment, which is exemplified by 8×12, that is, there are 8 rows and 12 columns of sub-pixels. For more convenient description, each sub-pixel is marked, the sub-pixel of the Nth row and the Mth column is marked as Anm, and the sub-pixel of the first row and the first column is marked as A11.

The data lines D1 and D2 are one data line pair, the data lines D3 and D4 are one data line pair, and so on.

Two sub-pixels are disposed between D1 and D2, and D1 is connected to the sub-pixel A11, and D2 is connected to the sub-pixel A12. In such manner, the voltage is loaded to the sub-pixels in the first driving manner, and each data line in the data line pair loads the voltage to the adjacent sub-pixels on the inner side of such data line.

Two sub-pixels are disposed between D5 and D6, D5 is connected to the sub-pixel A16 and D6 is connected to the sub-pixel A15. In such manner, the voltage is loaded to the sub-pixels in the second driving manner, and each of the data line pairs loads the voltage to the non-adjacent sub-pixels on the inner side of such data line.

According to the above rule, within one frame, the voltage is loaded to the sub-pixels alternately in the first driving manner or the second driving manner every two sub-pixels in the direction of the data lines according to the embodiment, that is, at the first moment and the second moment, the voltage is loaded to the sub-pixels in the first driving manner, at the third moment and the fourth moment, the voltage is loaded to the sub-pixels in the second driving manner, at the fifth moment and the sixth moment, the voltage is loaded to the sub-pixels in the first driving manner, at the seventh moment and the eighth moment, the voltage is loaded to the sub-pixels in the second driving manner and so on. In the present embodiment, the first predetermined interval is every other two sub-pixels.

In the present embodiment, the voltage is loaded to the sub-pixels alternately in the first driving manner or the second driving manner every other four sub-pixels in the direction of the scan lines, that is, at the same moment, D1, D2, D3 and D4 load the voltage to the sub-pixels in the first driving manner, D5, D6, D7 and D8 load the voltage to the sub-pixels in the in the second driving manner, and so on. In the present embodiment, the second predetermined interval is every other four sub-pixels. In the data line pair, the adjacent data line pairs alternately load in the first driving manner and the second driving manner.

For the present embodiment, the polarities of two adjacent data lines are also alternately changed. Within one frame, the data line D1 is loaded with the positive polarity voltage, the data line D2 is loaded with the negative polarity voltage, the data line D3 is loaded with the positive polarity voltage, the data line D4 is loaded with the negative polarity voltage, and so on. In the direction of the data lines, the polarity of the data lines is constant within one frame, but for the driving architecture of the present invention, the polarity of the voltage loaded to the sub-pixels of each column is inverted once every two sub-pixels, thereby achieving 2-Line inversion. The polarity of the sub-pixels of each column is in the two-positive and two-negative cycle.

Similarly, in the direction of the scan lines, the polarity of the data lines is column inversion within one frame, but for the driving architecture of the embodiment, the polarity of the voltage loaded to the sub-pixels of each row is alternately inverted. Besides, the sub-pixel polarity of each row is in one-negative and one-positive cycle, and the positive and negative polarities of every four sub-pixels are inverted once, that is, +−+−−+−++−+−+−+.

Figure 14:
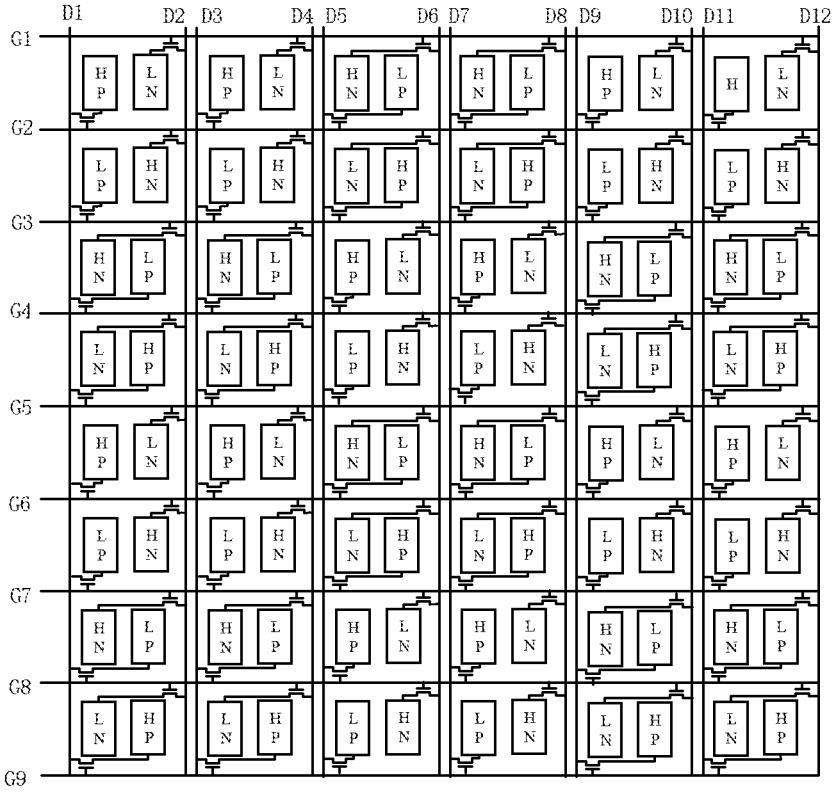
FIG. 14 is a schematic diagram of pixel display of a low-color shift pixel matrix according to the sixth embodiment of the present invention.

Specific to the architecture of the present embodiment, referring to FIG. 14, FIG. 14 is a schematic diagram of pixel display of a low-color shift pixel matrix according to an embodiment of the present invention. The specific explanation is as follows.

At a first moment within a frame, the scan signal is loaded on the scan line G1 of the first row, the voltage corresponding to the LN is loaded to the pixel A12 on the second data line D2, the voltage corresponding to the LN is loaded to the pixel A14 on the fourth data line D4, the voltage corresponding to the HN is loaded to the pixel A15 on the sixth data line D6, the voltage corresponding to the HN is loaded to the pixel A17 on the eighth data line D8, and according to the above rule, the corresponding polarities and gray scale voltages are loaded to other pixels of the first row.

At the next moment (i.e., the second moment), the scan signal is loaded on the scan line G2 of the second row, the voltage corresponding to HP is loaded to the pixel A11 on the first data line D1, the voltage corresponding to the HN is loaded to the pixel A22 on the second data line D2, the voltage corresponding to the HP is loaded to the pixel A13 on the third data line D3, the voltage corresponding to the HN is loaded to the pixel A24 on the fourth data line D4, the voltage corresponding to the LP is loaded to the pixel A16 on the fifth data line D5, the voltage corresponding to LN is loaded to the pixel A25 on the sixth data line D6, the voltage corresponding to the LP is loaded to the pixel A18 on the seventh data line D7, the voltage corresponding to the LN is loaded to the pixel A27 on the eighth data line D8, and according to the above rule, the corresponding polarities and gray scale voltages are to other pixels of the second row.

At the next moment (i.e., the third moment), the scan signal is loaded on the scan line G3 of the third row, the voltage corresponding to the LP is loaded to the pixel A21 on the first data line D1, the voltage corresponding to the HN is loaded to the pixel A31 on the second data line D2, the voltage corresponding to the LP is loaded to the pixel A23 on the third data line D3, the voltage corresponding to the HN is loaded to the pixel A33 on the fourth data line D4, the voltage corresponding to the HP is loaded to the pixel A26 on the fifth data line D5, the voltage corresponding to the LN is loaded to the pixel A36 on the data line D6, the voltage corresponding to the HP is loaded to the pixel A28 on the seventh data line D7, the voltage corresponding to the LN is loaded to the pixel A38 on the sixth data line D6, and according to the above rule, the corresponding polarities and gray scale voltages are loaded to other pixels of the third row.

At the next moment (i.e., the fourth moment), the scan signal is loaded on the scan line G4 of the fourth row, the voltage corresponding to the LP is loaded to the pixel A32 on the first data line D1, the voltage corresponding to the LN is loaded to the pixel A41 on the second data line D2, the voltage corresponding to the LP is loaded to the pixel A34 on the third data line D3, the voltage corresponding to the LN is loaded to the pixel A43 on the fourth data line D4, the voltage corresponding to the HP is loaded to the pixel A35 on the fifth data line D5, the voltage corresponding to the HN is loaded to the pixel A46 on the data line D6, the voltage corresponding to the HP is loaded to the pixel A37 on the seventh data line D7, the voltage corresponding to the HN is loaded to the pixel A48 on the eighth data line D8, and according to the above rule, the corresponding polarities and gray scale voltages are loaded to other pixels of the fourth row.

At the next moment (i.e., the fifth moment), the scan signal is loaded on the scan line G5 of the fifth line, the voltage corresponding to the HP is loaded to the pixel A42 on the first data line D1, the voltage corresponding to the LN is loaded to the pixel A52 on the second data line D2, the voltage corresponding to the HP is loaded to the pixel A44 on the third data line D3, the voltage corresponding to LN is loaded to the pixel A54 on the fourth data line D4, the voltage corresponding to the LP is loaded to the pixel A45 on the fifth data line D5, the voltage corresponding to HN is loaded to the pixel A55 on the sixth data line D6, the voltage corresponding to the LP is loaded to the pixel A47 on the seventh data line D7, the voltage corresponding to the HN is loaded to the pixel A57 on the eighth data line D8, and according to the above rule, the corresponding polarities and gray scale voltages are loaded to other pixels of the fifth row.

In the present embodiment, the voltage loading conditions at the first five scanning moments are listed, and the corresponding voltages are sequentially loaded to other sub-pixels at other moments according to the above rules. That is to say, the minimum unit of the cyclic loading is 4×8 sub-pixels, and the voltage loading condition at the sixth moment can refer to the voltage loading condition at the second moment.

According to the above embodiment of the present invention, by alternately loading the positive and negative polarity voltages and the high and low gray scale voltages to the pixel matrix, the side visibility can be improved, so that the pixels in the pixel matrix are not affected by the polarity, the problems such as crosstalk and bright and dark lines are improved, and the display effect is improved.

Seventh Embodiment

Figure 15:
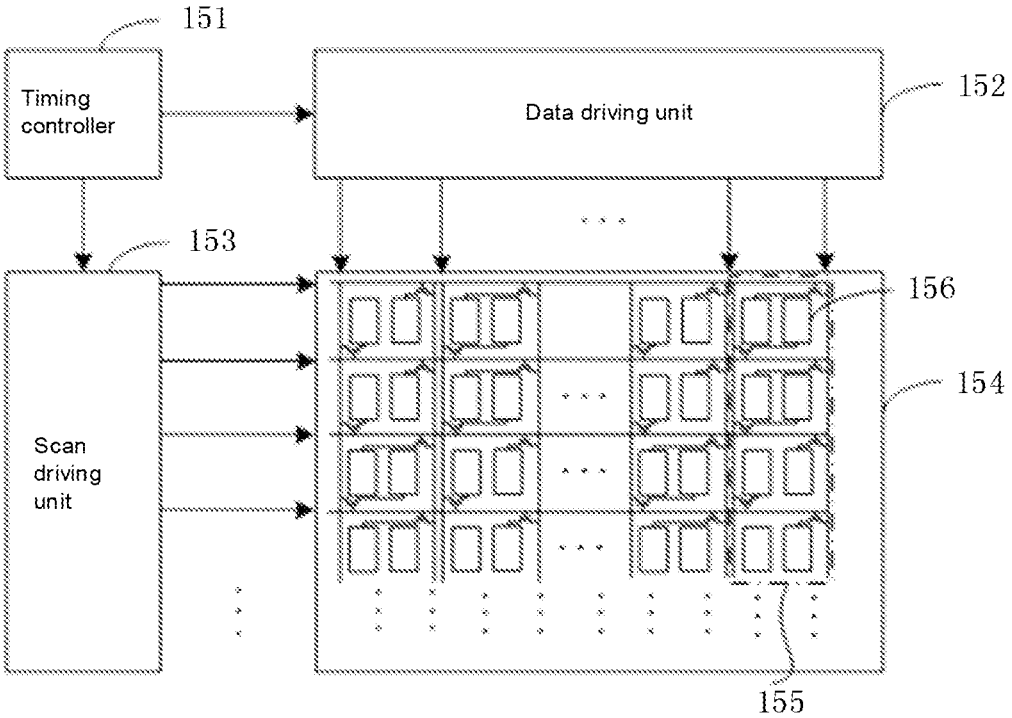
FIG. 15 is a schematic diagram of a driving device for a low-color shift pixel matrix according to a seventh embodiment of the present invention.

A seventh embodiment of the present invention provides a driving device for a low-color shift pixel matrix, referring to FIG. 15. The display device includes a timing controller 151, a data driving unit 152, a scan driving unit 153 and a pixel matrix 154, wherein the pixel matrix 154 includes a plurality of data line pairs 155 formed by a plurality of two adjacent data lines, wherein two sub-pixels 156 are disposed on the inner side of each pair of data lines 155, and a voltage is loaded to one corresponding sub-pixel on the inner side. Within one frame and in the direction of the data lines, the voltage is alternately loaded to the sub-pixels in a first driving manner or a second driving manner according to a first predetermined interval; and in the direction of scan lines, the voltage is alternately loaded to the sub-pixels in the first driving manner or the second driving manner according to a second predetermined interval.

The timing controller 151 is configured to acquire original pixel data, form first gray scale data and second gray scale data according to the original pixel data, and output the first gray scale data and the second gray scale data to the data driving unit 152.

The data driving unit 152 is configured to generate a first driving voltage according to the first gray scale data, and generate a second driving voltage according to the second gray scale data; and load the first driving voltage or the second driving voltage to the pixel matrix 154 in the direction of the data lines within one frame.

In a specific embodiment, the data driving unit 152 is further configured to control each data line in the data line pairs to load the voltage to the adjacent sub-pixels on the inner side of such data line.

In a specific embodiment, the data driving unit 152 is further configured to control each data line in the data line pairs to load the voltage to the non-adjacent sub-pixels on the inner side of such data line.

In a specific embodiment, the timing controller 151 is specifically configured to acquire an original pixel value of each pixel position according to the original pixel data, and convert the original pixel value of each pixel position to the first gray scale data or the second gray scale data according to a predetermined conversion manner.

In summary, according to the driving device for a low-color shift pixel matrix in the present embodiment, the plurality of data line pairs are formed by a plurality of two adjacent data lines, two sub-pixels are disposed on the inner side of each pair of data lines, and the voltage is loaded to one corresponding sub-pixel on the inner side. Therefore, the 8-Domain low-color shift display effect is realized without increasing the additional power consumption of the panel.

The foregoing contents are detailed description of the disclosure in conjunction with specific preferred embodiments and concrete embodiments of the disclosure are not limited to these description. For the person skilled in the art of the disclosure, without departing from the concept of the disclosure, simple deductions or substitutions can be made and should be included in the protection scope of the application.

What is claimed is:

1. A display device, comprising a timing controller, a data driving unit, a scan driving unit and a pixel matrix, wherein in the pixel matrix, polarities of data lines are inverted once every two columns, a polarity of a voltage loaded in a column direction is exchanged once every N sub-pixels, and each data line alternately loads voltages to an Ith column and an (I+2)th column of sub-pixels every N sub-pixels along an extending direction of the data line; the timing controller is individually connected to the data driving unit and the scan driving unit, the data driving unit is connected to the pixel matrix by the data lines, the scan driving unit is connected to the pixel matrix by scan lines, and each of the scan lines is extending along a row direction intersecting with the column direction;

the timing controller is configured to form first gray scale data and second gray scale data according to original pixel data, and output the first gray scale data and the second gray scale data to the data driving unit; and the data driving unit is configured to generate a first driving voltage according to the first gray scale data, and generate a second driving voltage according to the second gray scale data; and load the first driving voltage or the second driving voltage to the pixel matrix by the data lines within one frame, wherein I≥1, N≥2;

wherein the N sub-pixels are located at a same side of the data line connected to the N sub-pixels, and the N sub-pixels are located in a same column and have a same polarity;

wherein the data driving unit is further configured to alternately load the first driving voltage and the second driving voltage to adjacent sub-pixels in the column direction, and alternately load the first driving voltage and the second driving voltage to adjacent sub-pixels in the row direction; the first driving voltage is one of high gray scale voltage and low gray scale voltage, and the second driving voltage is the other one of high gray scale voltage and low gray scale voltage.

2. The display device according to claim 1, wherein the data lines are alternately routed on the left side of the Ith column of sub-pixels and the left side of the (I+1)th column of sub-pixels, and form a bow-shaped routing structure.

3. The display device according to claim 1, wherein the timing controller is further configured to acquire an original pixel value of each pixel position according to the original pixel data, and convert the original pixel value of each pixel position to first gray scale data or second gray scale data according to a predetermined conversion manner.

4. A display device, comprising a timing controller, a data driving unit, a scan driving unit and a pixel matrix, wherein in the pixel matrix, polarities of data lines are inverted once every two columns, a polarity of a voltage loaded in a column direction is exchanged once every N sub-pixels, and at least one of the data lines each alternately loads voltages to an Ith column and an (I+2)th column of sub-pixels every N sub-pixels along an extending direction of the data line; the timing controller is individually connected to the data driving unit and the scan driving unit, the data driving unit is connected to the pixel matrix by the data lines, the scan driving unit is connected to the pixel matrix by scan lines, and each of the scan lines is extending along a row direction intersecting with the column direction;

the timing controller is configured to form first gray scale data and second gray scale data according to original pixel data, and output the first gray scale data and the second gray scale data to the data driving unit; and the data driving unit is configured to generate a first driving voltage according to the first gray scale data, and generate a second driving voltage according to the second gray scale data; and load the first driving voltage or the second driving voltage to the pixel matrix by the data lines within one frame, wherein I≥1, N≥2;

wherein the N sub-pixels are located at a same side of the data line connected to the N sub-pixels, and the N sub-pixels are located in a same column and have a same polarity;

wherein all sub-pixels in a same row are connected to a same one of the scan lines;

wherein at least one of the data lines is alternately routed on the left side of the Ith column of sub-pixels and the left side of the (I+1)th column of sub-pixels, and form a bow-shaped routing structure;

wherein the data driving unit is further configured to alternately load the first driving voltage and the second driving voltage to adjacent sub-pixels in the column direction; and alternately load the first driving voltage and the second driving voltage to adjacent sub-pixels in the row direction;

wherein the first driving voltage is one of high gray scale voltage and low gray scale voltage, and the second driving voltage is the other one of high gray scale voltage and low gray scale voltage.

5. The display device according to claim 4, wherein the extending direction of the data line is a routed direction of the data line including a bow-shaped routing structure.

* * * * *